United States Patent [19]

Harng

[11] Patent Number: 4,479,504

[45] Date of Patent: Oct. 30, 1984

[54] RELEASE DEVICE OF DOUBLE-SHADE UMBRELLA

[76] Inventor: Goan Harng, No. 170, Pei Ning Rd., Ho Mei, Chang Hua Hsien, Taiwan, 508 R.O.C.

[21] Appl. No.: 534,438

[22] Filed: Sep. 21, 1983

[51] Int. Cl.[3] ..... A45B 19/00; A45B 25/14

[52] U.S. Cl. ..... 135/20 A; 135/24

[58] Field of Search ..... 135/20 R, 20 A, 20 B, 135/20 M, 22, 24, 30, 37, 16

[56] References Cited

U.S. PATENT DOCUMENTS

| | | | |
|---|---|---|---|
| 256,308 | 4/1882 | Forster | 135/20 A |
| 3,464,431 | 9/1969 | Loeffler | 135/20 A |
| 4,144,900 | 3/1979 | Kinski | 135/20 A |
| 4,274,429 | 6/1981 | Kinski | 135/20 A |
| 4,418,707 | 12/1983 | Wu | 135/24 |
| 4,421,133 | 12/1983 | Huang | 135/22 |

*Primary Examiner*—Robert A. Hafer
*Assistant Examiner*—Arnold W. Kramer
*Attorney, Agent, or Firm*—Armstrong, Nikaido, Marmelstein & Kubovcik

[57] ABSTRACT

This invention relates a release device of double-shade umbrella specially for opening simultaneously the two sets of ribs of a paramours's umbrella by pressing a T plate in the umbrella handle and forcing the two spring retainers in the umbrella canes to release the outer telescopic tubes of the canes, and characterized by combining two separate release devices in one with a T plate aligned with two retainers so as to unfold two shades simultaneously with one hand.

2 Claims, 3 Drawing Figures

RELEASE DEVICE OF DOUBLE-SHADE UMBRELLA

BACKGROUND AND SUMMARY OF THE INVENTION

A conventional double-shade umbrella also known as paramours' umbrella is a combination of two separate umbrellas. This double-shade umbrella has two separate release mechanisms for its two joined shades on two radial frames which have to be folded or unfolded simultaneously. To open the umbrella, one has to use both hands to hold the umbrella canes one by one and press the release keys respectively and simultaneously so that the two joined shades will be opened simultaneously without damage to the umbrella ribs and shades. In other words, special care must be taken to use the umbrella or damage would be caused when only one shade and its radial frame is suddenly opened.

The inventor has engaged in the design and manufacture of various umbrellas for many years and known well the construction and features of the paramours' umbrella. Aimed at the aforesaid disadvantages, improvement is made as described below.

The release device of double-shade umbrella of this invention comprises a T plate installed in the umbrella handle which, when pressed, can force the retainers in the umbrella canes to retreat and let the two joined shades open simultaneously. So the main purpose of this invention is to meet the structural nature of double-shade umbrella and to substitute a single release device for two so as to open the two joined shades simultaneously by one push, to prevent damage due to carelessness, and to increase the safety and durability.

Another purpose of this invention is to make the use of such umbrella easier by changing the two-hand operation to one-hand operation.

DETAILED DESCRIPTION

Figure 1:
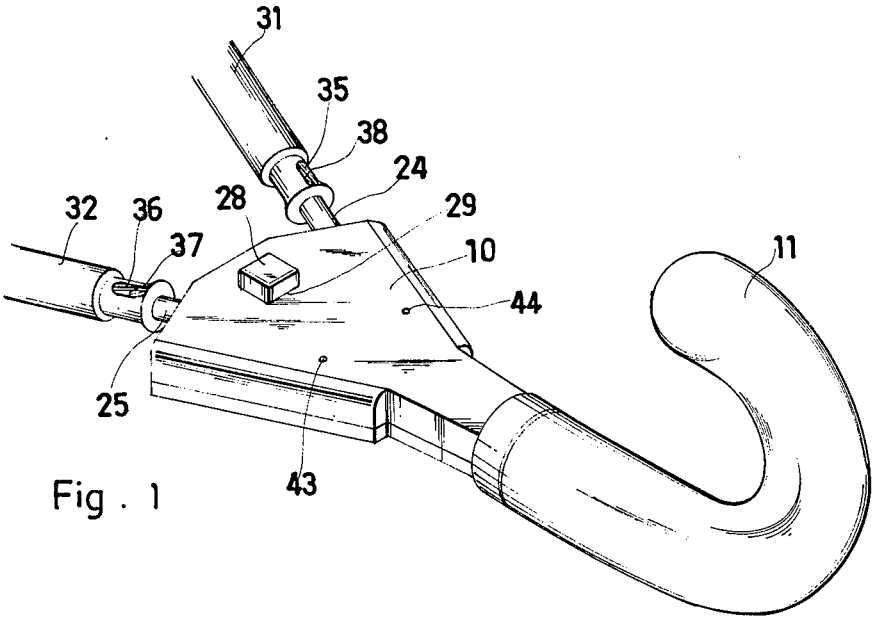
FIG. 1 is a front view of the umbrella handle which employs the present invention.
Figure 2:
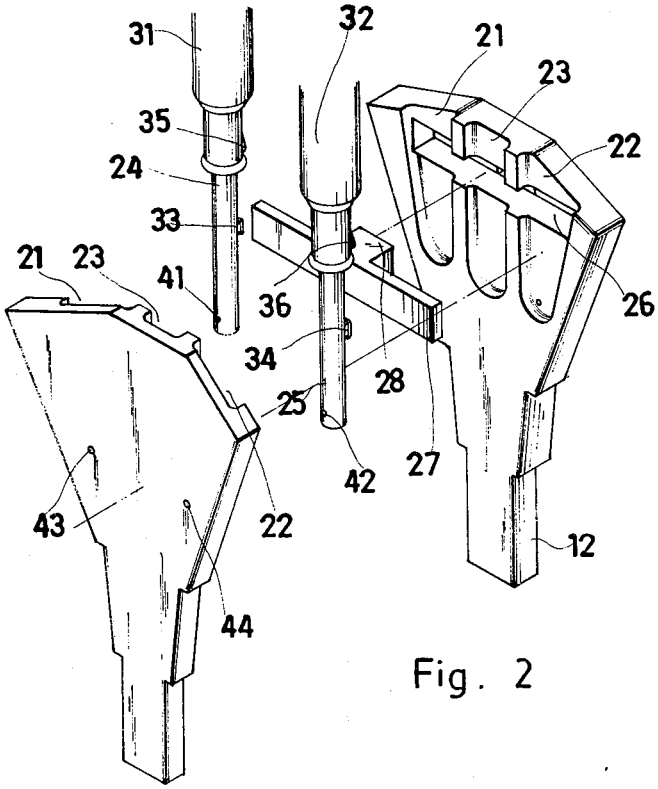
FIG. 2 is a hypothetical sectional view of the umbrella handle of FIG. 1.

Referring now to the drawings the nature of the release device of this invention is described as follows:

As shown in FIG. 1 and FIG. 2, the umbrella handle 10 has a holder 11 fitted over its end, and three long elliptical holes 21, 22, 23 among which the holes 21, 22 are for accommodating two umbrella canes 24, 25. The long elliptical holes are designed to give room for outward movement of the umbrella canes 24, 25 when the joined shades (not shown) are unfolded. The middle hole 23 is designed for esthetical and weight-reducing purpose. In addition, a cross slot 26 is provided across the three holes 21, 22, 23 for accommodating a T plate 27 of which the release key 28 comes out of the hole 29 in the front side of the umbrella handle 10. The inner tubes 24, 25 of the telescopic umbrella canes with their ends against the bottoms of the holes 21, 22 have key heads 33, 34 protruding out into the cross slot 26 and against the T plate 27. The outer tubes 31, 32 of the telescopic umbrella canes are above the holes 21, 22. When the release key 28 is pressed, the T plate 27 is pushed forward and forces the key heads 33, 34 to retreat, at the same time, two retainers 35, 36 in the retaining holes 37, 38 retaining the outer tubes 31, 32 are also forced to retreat and release the outer tubes 31, 32 which slide upward. Two shades on the folding radial frames are unfolded at the same time. The inner tubes 24, 25 of the telescopic umbrella canes have holes 41, 42 at their lower ends to be used with the holes 43, 44 in the umbrella handle 10 for fastening by means of a pin or bolt (not shown).

Figure 3:
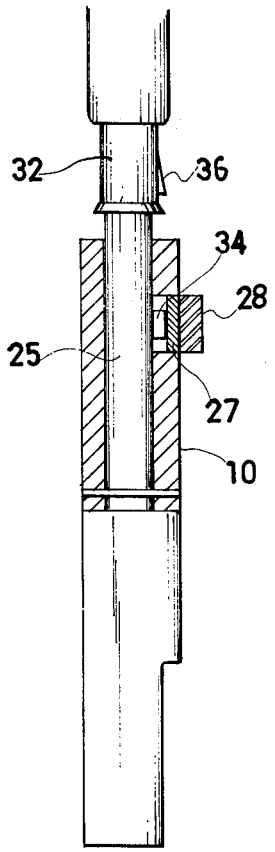
FIG. 3 is a side sectional view of the umbrella handle of FIG. 1.

From FIG. 3, it is clearly seen that when the T plate 27 is pressed, the release key heads 33, 34 protruding outside the inner tubes 24, 25 of the telescopic umbrella canes against the T plate 27 will retreat together with the retainers 35, 36 inside the inner telescopic tubes 24, 25 and release the outer telescopic tubes 31, 32 which will then slide upward.

Accordingly, the release device of this invention which is very simple, novel and practical, can improve the separate operation of a conventional double-shade umbrella and indirectly increase the protection of the same.

What is claimed is:

1. A release device of double-shade umbrella comprising an umbrella handle having three long elliptical holes and a cross slot, two telescopic umbrella canes inserted in the elliptical holes and having retainers, and a T plate in the cross slot with its release key coming out of the front side of the handle, said retainers having their key heads against the T plate so that when the release key of the T plate is pressed, the retainers will be forced to retreat and release the outer tubes of the telescopic umbrella canes.

2. A release device of double-shade umbrella according to claim 1, in which said T plate is so installed that its flat side is aligned with the key heads of the retainers and its key head comes out of the front side of the umbrella handle to facilitate pressing operation with one hand.

* * * * *